US005755267A

United States Patent [19]

Eberhard et al.

[11] Patent Number: 5,755,267

[45] Date of Patent: May 26, 1998

[54] WEAVING MACHINE OPERATION BY CONTROL OF TORQUE AND ROTATION ANGLE OF A MECHANICAL TRANSMISSION

[75] Inventors: Ernst Eberhard, Dürnten; Klaus Berktold, Rüti, both of Switzerland

[73] Assignee: Sulzer Rueti AG, Rueti, Switzerland

[21] Appl. No.: 791,923

[22] Filed: Jan. 31, 1997

[30] Foreign Application Priority Data

Apr. 4, 1996 [EP] European Pat. Off. ..... 96810214

[51] Int. Cl.[6] ..... D03C 3/32; D03D 51/02

[52] U.S. Cl. ..... 139/1 E; 318/432

[58] Field of Search ..... 139/59, 1 E; 318/611, 318/432, 625

[56] References Cited

U.S. PATENT DOCUMENTS

| | | | |
|---|---|---|---|
| 477,485 | 10/1892 | Murrell et al. | 74/687 |
| 4,298,107 | 11/1981 | Schmitz et al. | 192/12 D |
| 4,980,623 | 12/1990 | Anton | 318/432 |
| 5,033,328 | 7/1991 | Shimanaka | 74/866 |
| 5,185,543 | 2/1993 | Tebbe | 310/51 |
| 5,226,390 | 7/1993 | Nakagawa | 123/436 |
| 5,306,993 | 4/1994 | De Fries et al. | 318/561 |
| 5,613,525 | 3/1997 | Schwendimann | 139/1 E |
| 5,642,757 | 7/1997 | Froment et al. | 139/1 E |
| 5,646,495 | 7/1997 | Toyozawa et al. | 318/625 |

FOREIGN PATENT DOCUMENTS

| | | |
|---|---|---|
| 1006781A6 | 12/1994 | Belgium . |
| 0 241 076 | 10/1987 | European Pat. Off. . |
| 2 443 407 | 7/1980 | France . |
| 9102560 | 7/1991 | Germany . |

OTHER PUBLICATIONS

Patent Abstracts of Japan, vol. 016, No. 043 (C-0907), Feb. 4, 1992, & JP 03 249233 A (Murata Mach. Ltd.), Nov. 7, 1991, Abstract.

*Primary Examiner*—Andy Falik

*Attorney, Agent, or Firm*—Townsend and Townsend and Crew LLP

[57] ABSTRACT

A Jacquard weaving machine includes a weaving apparatus and a Jacquard apparatus, which are both connected to one another for the transmission of torque via a mechanical transmission device and are driven by a common motor. An additional drive device is provided which acts at least on the Jacquard apparatus. An angle sensor is provided for the measurement of an angle of rotation and/or a torque sensor is provided for the measurement of the torque present between the weaving machine and the Jacquard apparatus. The sensors are connected to a control device that controls the drive device in such a manner that peak values in the torque and/or fluctuations in the speed of rotation are reduced.

10 Claims, 2 Drawing Sheets

Fig.3
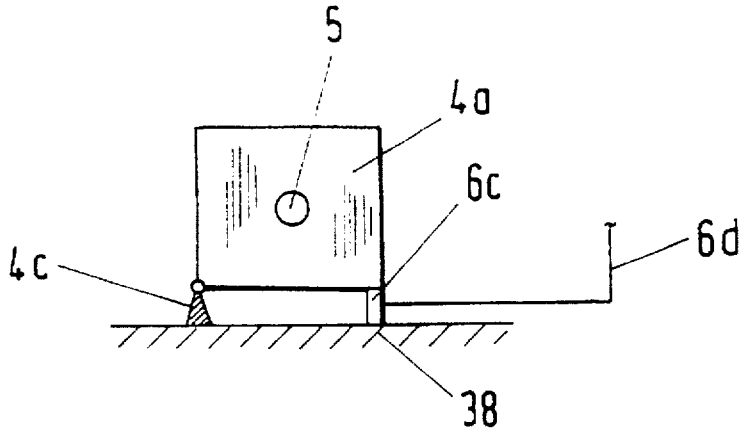
Fig.4a
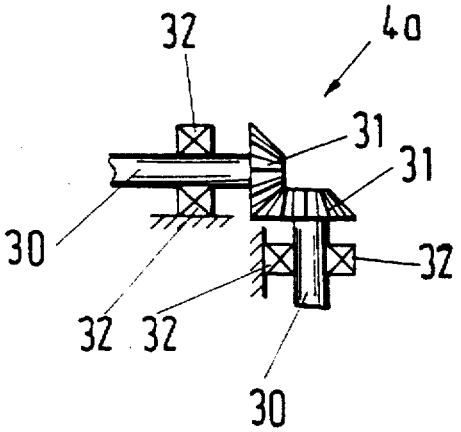
Fig.4b
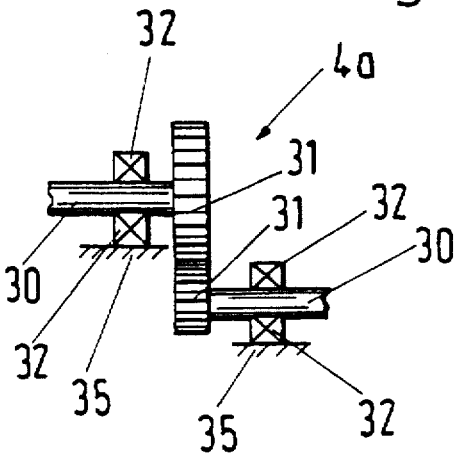
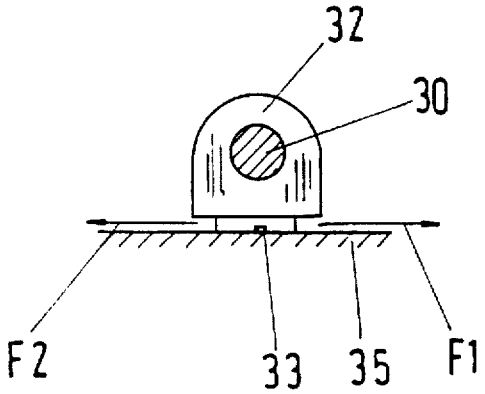
Fig.4c

WEAVING MACHINE OPERATION BY CONTROL OF TORQUE AND ROTATION ANGLE OF A MECHANICAL TRANSMISSION

BACKGROUND OF THE INVENTION

1. Field of the Invention

The invention relates to a Jacquard weaving machine and to a method for operating the Jacquard weaving machine.

2. Description of the Prior Art

Known Jacquard weaving machines comprise a weaving machine for the insertion of a weft thread as well as a Jacquard apparatus for the control of the formation of sheds from the warp threads. The weaving machine and the Jacquard apparatus are generally connected to one another via a transmission as well as a Cardan shaft and are jointly driven by the motor of the weaving machine. An arrangement of this kind has the disadvantage that a motor with a high power output is required, in particular for driving a large Jacquard apparatus. Furthermore, both the weaving machine and the Jacquard apparatus have an individual torque which varies as a function of the angle of rotation during free running, which leads to a variable angular speed of rotation. This is caused by various oscillating inertial components. If the weaving machine and the Jacquard apparatus are connected to one another to form a single Jacquard weaving machine via a transmission device such as for example a Cardan shaft, then high fluctuations in the torque arise, through which the drive, the transmission, the shaft and also the bearings are additionally stressed to a considerable extent. This requires drive components of massive construction, reduces their lifetime and leads in addition to energy losses.

SUMMARY OF THE INVENTION

The object of the present invention is to propose a Jacquard weaving machine that can be operated more economically.

The present Jacquard weaving machine in accordance with the invention has an additionally acting auxiliary drive as well as at least one sensor for measuring the angle of rotation and/or the torque present between the weaving machine and the Jacquard apparatus. The auxiliary drive can act for example directly on the Jacquard apparatus, or directly on the weaving machine, or directly on the Cardan shaft. The sensor signal is led to a control device which controls the auxiliary drive in such a manner that the fluctuations in the speed of rotation and/or of the torque and/or the peak torque values of the components of the Jacquard weaving machine are reduced. Here the auxiliary drive, usually executed as an electric motor, can act either in a driving manner or in a braking manner on the Jacquard apparatus. Both the weaving machine and the Jacquard apparatus have in themselves a torque which varies depending on the angle of rotation, with the required torque depending in addition on such operating parameters as the speed of rotation, the pattern produced, or the type of cloth. The connection of the weaving machine and the Jacquard apparatus, for example via a Cardan shaft, imposes a common speed of rotation on the two devices. Therefore a very complex relationship arises between the speed of rotation and the torque of a Jacquard weaving machine. With respect to the control of the speed of rotation of a Jacquard weaving machine, the three following states, which differ in principle, must amongst others be taken into account. If the weaving machine and the Jacquard apparatus attempt a movement in contrary senses, which means that the one device requires an increasing torque as a function of the angle of rotation and the other device requires a torque which decreases as a function of the angle of rotation, then this state produces a high torque in the coupling device which connects the Jacquard apparatus mechanically to the weaving machine, for example in a Cardan shaft or in a transmission. In this operating state the auxiliary motor acts on the Jacquard apparatus in such a manner that the torque in the coupling device, e.g. in the Cardan shaft, is reduced. In a second operating state both the weaving machine and the Jacquard apparatus attempt a movement in the same sense, with both devices requiring a torque which decreases as a function of the angle of rotation, which produces a temporary increase in the speed of rotation of the Jacquard weaving machine. In this operating state the auxiliary motor acts in a braking manner on the Jacquard apparatus, which has a stabilizing effect on the fluctuation in the speed of rotation. In a third operating state both devices attempt a movement in the same sense, with both devices requiring a torque which increases as a function of the angle of rotation, which produces a temporary decrease in the speed of rotation of the Jacquard weaving machine. In this operating state the auxiliary motor acts in a driving manner on the Jacquard apparatus, which likewise acts in a stabilizing manner on the fluctuations in the speed of rotation.

An advantage of the invention is thus to be seen in the fact that fluctuations in the speed of rotation can be reduced and/or that peak torque values in the torque transmission device arranged between the Jacquard apparatus and the weaving machine can be reduced. A further advantage is to be seen in the fact that both the weaving machine and the Jacquard apparatus run synchronously to one another even in the presence of high fluctuations in the speed of rotation, with the auxiliary drive reducing the fluctuations in the speed of rotation and/or the fluctuations in torque. A further advantage of the invention is to be seen in the fact that a weaving machine in standard constructional form, which has in particular a standard motor for the drive, can be used for the Jacquard weaving machine, since, through the apparatus in accordance with the invention as well as the corresponding control procedure, peak powers are either no longer necessary, or else they can be partially produced by the auxiliary drive, so that a standard motor is sufficient to drive the weaving machine. A further advantage is to be seen in the fact that a Jacquard weaving machine which has the apparatus in accordance with the invention can be operated at a higher speed of rotation with respect to the previously known embodiments so that more cloth per unit time can be produced.

The mechanical coupling device for the transmission of torque between the weaving machine and the Jacquard apparatus can be executed for example as a Cardan shaft yet also have a different type of mechanical transmission such as for example a chain drive or a roller chain.

The torque transmitted between the weaving machine and the Jacquard apparatus can be measured by different measurement methods and/or measurement sensors as well as at various positions on the Jacquard weaving machine. Thus for example the torque can be determined by measuring the torsion of the Cardan shaft. Furthermore, the measurement of the reaction force present at a transmission is also suitable for determining the torque. A further possibility is the measurement of the torque at the shaft of the Jacquard apparatus directly at its entry into the housing of the Jacquard apparatus.

BRIEF DESCRIPTION OF THE DRAWINGS

FIG. 3 is a side view of a transmission;

FIGS. 4a, 4b are alternate embodiments of transmissions; and

FIG. 4c a torque measurement device for transmissions.

DETAILED DESCRIPTION OF THE PREFERRED EXEMPLARY EMBODIMENTS

Figure 1:
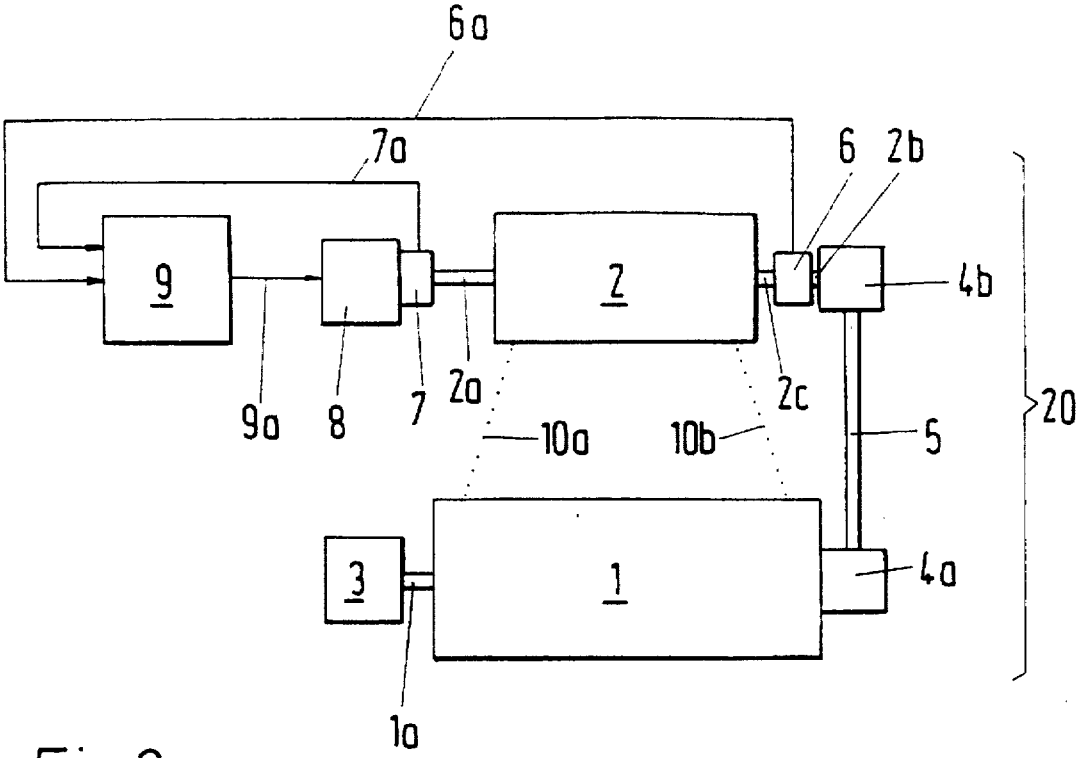
FIG. 1 is a schematic arrangement of a Jacquard weaving machine in accordance with the present invention.

FIG. 1 shows a Jacquard weaving machine 20 comprising a weaving machine 1 with a shaft 1a and a drive motor 3 as well as a Jacquard apparatus 2 with a shaft 2a, 2b, 2c. The two shafts 1a and 2a, 2b, 2c are rigidly connected to one another via a transmission device 4a, 4b, 5, an angular drive 4a, 4b as well as a Cardan shaft 5, so that both the Jacquard apparatus 2 and the weaving machine 1 run synchronously or nearly synchronously with respect to one another. The one end region of the shaft 2a, 2b, 2c is connected to the angular transmission 4b. At the other end region of the shaft 2a, 2b, 2c there is arranged an auxiliary motor 8 which produces a torque on the shaft 2a, 2b, 2c. In addition the auxiliary motor 8 has a sensor 7 for measuring the angle of rotation of the shaft 2a, 2b, 2c. Furthermore, a sensor 6 for measuring a torque present at the shaft 2a, 2b, 2c is arranged between the angular transmission 4b and the Jacquard apparatus 2. The sensors 6, 7 are connected via signal lines 6a, 7a to a control device 9 which is connected to the auxiliary motor 8 via a drive line 9a. Furthermore, the connection cords 10a, 10b which extend between the Jacquard apparatus 2 and the weaving machine 1 and determine the position of the warp threads, and thus the formation of sheds, are illustrated in suggestion.

The auxiliary motor 8 is controlled by the control device 9 in such a manner that the peak torque values and/or the fluctuations in torque to be transmitted by the Cardan shaft 5 are reduced and/or that the fluctuations in the speed of rotation of the Jacquard weaving machine 20 are reduced and/or that the electric power consumption of the entire Jacquard weaving machine 20 is reduced. The torque present between the Jacquard apparatus 2 and the weaving machine 1 is measured by the sensor 6 and fed to the control device 9. The auxiliary motor 8 is controlled by the control device 9 in accordance with a selectable task.

Suitable tasks are:

a) control of the torque

The auxiliary motor 8 is controlled in such a manner that the torque transmitted in the shaft 8 is influenced. Suitable for this are such diverse control strategies as:

- limitation of the positive or negative torque to an allowable maximum value
- reduction of the torque by a constant factor or in accordance with a prespecifiable, mathematical relationship
- limitation or reduction of the change in torque as a function of time
- both a limitation of the maximum torque present as well as a simultaneous reduction of the torque
- limitation of the torque to a minimum value tending toward 0.

In the exemplary embodiment in accordance with FIG. 1 the torque is measured at the shaft 2b, 2c. The torque can however also be measured at another position of the torque transmission device between the weaving machine 1 and the Jacquard apparatus 2. Thus for example the torsion of the Cardan shaft 5 can be measured by means of strain gauges and the torque present can be calculated therefrom. A further device for measuring the torque is illustrated in FIG. 3. The shaft 5 as well as the one-sided pivotal bearing is visible from the side view of the transmission 4a. The transmission 4a is furthermore connected by the signal line 6d to a sensor 6c which also serves as a bearing. The torque transmitted by the shaft 5 produces reaction forces in the transmission 4a which are transmitted to the base 38 via the bearing 4c as well as via the sensor 6c. The reaction forces arising can thus be measured by the sensor 6c, from which the torque present at the shaft 5 can be measured.

Figure 2:
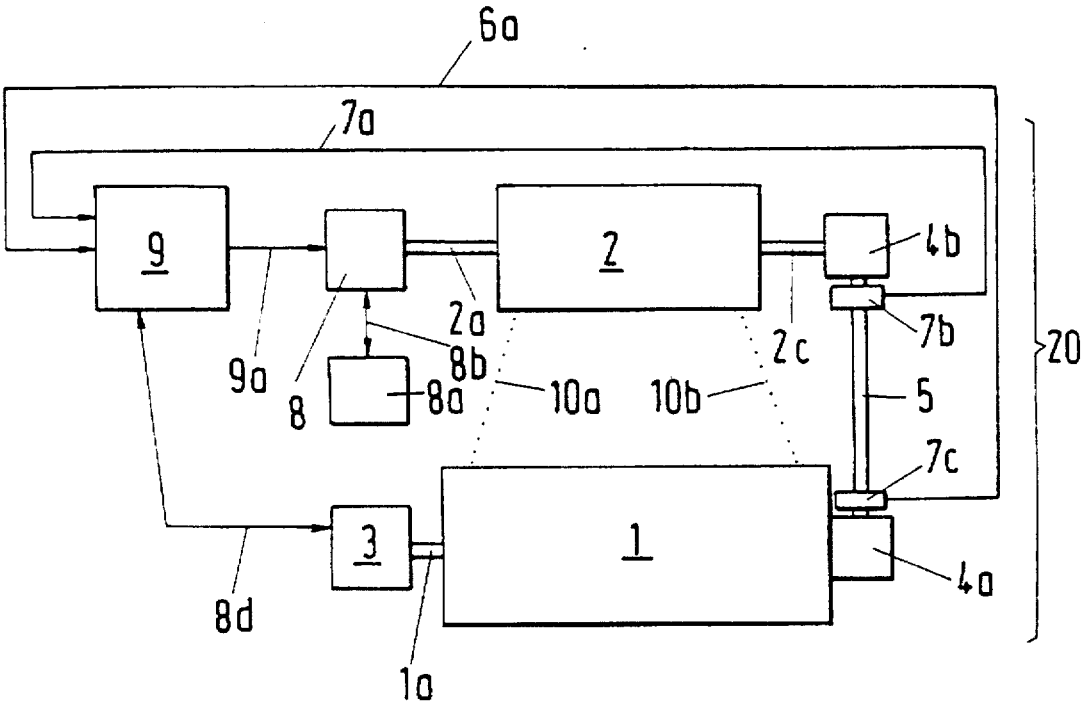
FIG. 2 is a schematic arrangement of a Jacquard weaving machine in accordance with an alternate embodiment of the present invention.

A further device for determining the torque transmitted between the weaving machine 1 and the Jacquard apparatus 2 is shown in FIG. 2. There, angle of rotation sensors 7, 7b, 7c, which are connected to the control device 9 via signal lines 6a, 7a, are arranged at each of the end regions of the Cardan shaft 5. The Cardan shaft 5 has an elasticity, due to which a torque that is present produces a torsion of the shaft 5, which can be measured by the rotation angle sensors 7b, 7c. For this purpose, sensors 7b, 7c with a sufficiently good angular resolution of for example 0.μ degree are used. The control device 9 can calculate the torque present from the difference of the two angle of rotation sensor signals 6a, 7a. If the speed of rotation of the shaft 5 is designated by $\omega$ and the time by t, then the angle of rotation sensor 7b, 7c measures the signal $\omega \cdot t$. Each of the two rotation angle sensors 7b, 7c measures a signal $\omega_1 \cdot t$ or a signal $\omega_2 \cdot t$ respectively, with the torque being proportional to the angular difference of the two rotation angle sensor signals, corresponding to $\omega_1 \cdot t - \omega_2 \cdot t$. Fluctuations of the rotational speed can be measured very well using this difference signal so that dynamic fluctuations in the torque can also be reliably measured.

The torque itself can also be calculated from other values, such as for example via the measurement of the power taken up by the motor 3.

The two angle sensors need not necessarily be arranged in the region of the Jacquard apparatus 2 or of the weaving machine 1, but can be arranged anywhere at rotating parts of the Jacquard weaving machine 20 insofar as the parts, such as for example the transmission, Cardan joints or a belt drive shaft located between the two measurement points, have no play or only insubstantial play. An especially economical arrangement for measuring the rotation angle is obtained if angle sensors which are already present, such as for example an angle sensor 7 already routinely built into the motor 8, are used.

A further task suitable for the control device 9 is that of b) control of the speed of rotation The speed of rotation of the Jacquard weaving machine can be measured at any suitable position, for example directly at the auxiliary motor 8 by means of a rotational angle sensor 7 as shown in FIG. 1 or by a measurement of the speed of rotation of the Cardan shaft 5 as shown in FIG. 2. The control device 9 controls the auxiliary motor 8 in such a manner that fluctuations in the speed of rotation are reduced through

- limitation of the speed of rotation to an allowable maximum value
- limitation of the peak values of the change in the speed of rotation
- reduction of the fluctuations in the speed of rotation to a value tending toward zero.

A further task suitable for the control device 9 is that of b) optimizing the power The auxiliary motor 8 can produce either a drive torque or a braking torque. In braking operation, energy can be transferred into an intermediate storage and taken back out of the storage by the auxiliary motor 8 in the driving mode of operation. This process can however have a poor efficiency, in particular if the storage cannot be filled any further and the excess energy must be dissipated as a heat loss. The Jacquard weaving machine 20 is thus advantageously controlled by the control device 9 in such a manner that no braking mode is necessary, or in such a manner that at least the braking energy does not exceed the storage capacity of the intermediate storage.

The control device 9 controls the Jacquard weaving machine 20 in such a manner that either a) a control of the torque b) a control of the speed of rotation c) an optimization of the power or a combination of these three control strategies is performed.

The control device 9 advantageously employs a flexible control strategy and takes the torque as well as the speed of rotation and the power consumption into account in order to control the auxiliary motor 8 so that none of these three values has excessive values during the operation of the Jacquard weaving machine 20.

The three control values can be combined in such a manner that, for example, if the torque of the weaving machine 1 as well as that of the Jacquard apparatus 2 change in the same sense as a function of the angle, then this results in a small torque in the Cardan shaft 5 so that in this case the speed of rotation of the Jacquard weaving machine is controlled.

if the torque of the weaving machine 1 as well as that of the Jacquard apparatus 2 change in opposite senses as a function of the angle of rotation, then this results in a large torque in the Cardan shaft 5 so that in this case the torque is controlled by the auxiliary motor 8 which produces torque on the Jacquard apparatus 2 in such a manner that the Cardan shaft 5 is relieved in order to protect the Cardan shaft 5 from a destruction.

if the speed of rotation lies below a predeterminable value, the auxiliary drive 8 is actuated in the driving sense in order to accelerate the Jacquard weaving machine 20; and if the speed of rotation lies above a predeterminable value, the auxiliary drive 8 is not actuated in order thereby to allow a speed of rotation above the predeterminable value, but instead to operate the auxiliary drive 8 as little as possible in braking mode, which produces a favorable total efficiency.

FIG. 2 shows an advantageous embodiment in which an intermediate storage device **8*a* is connected to the drive device 8 via a line 8*b*. Energy is fed to this storage device 8*a* during the braking operation of the auxiliary drive 8 and the energy stored in the storage device 8*a* is also fed back to the auxiliary drive 8 during a power output by the auxiliary drive 8. Fluctuations in the speed of rotation can in particular be compensated with an additional saving in energy by means of this energy exchange between the auxiliary drive 8 and the storage device 8*a*. The total power consumption of the Jacquard weaving machine 20 can be reduced by this method. The intermediate storage device 8*a* is normally a constituent of the drive device 8, with the energy exchange proceeding automatically in the drive device 8. The total power consumption can be further optimized by the energy consumption of the motor 3 being monitored by the control device 9 via a signal line 8*d*. It can prove advantageous to transmit the actual electric power of the motor 3 to the control device 9 via the signal line 8*d***. This power measurement can be used instead of a torque measurement for control purposes, in particular in a state of the weaving machine in which no other torque is available, for example when a sensor drops out.

FIG. **4*a* shows an angular transmission 4*a* with shafts 30, bearings 32 and gears 31. An angular transmission of this kind is suitable for the measurement of the torque transmitted via the shafts 30 if a sensor 33 in accordance with FIG. 4*c* is placed at at least one bearing 32. The side view of a bearing 32 with a shaft 30 shown in FIG. 4*c* is connected to a base 35 via a measurement device 33. The measurement device 33 enables the forces F1, F2 acting on the bearing 32 to be measured, from which the torque transmitted by the shaft 30 can be calculated. FIG. 4*b* shows a further exemplary embodiment of a transmission 4*c* with a bearing 32, a shaft 30 and gears 31. Here as well at least one bearing can be equipped with a measurement device 33 as shown in FIG. 4*c* so that the torque applied to the shaft 30** can be measured.

The weaving machine 1 as well as the Jacquard apparatus 2 can be coupled to one another in the most diverse of manners. In the exemplary embodiment of FIG. 1 the shaft parts **2*a*, 2*b*, 2*c* need not necessarily be components of the same shaft. The shaft parts 2*a*, 2*b*, 2*c* can also be connected to one another by transmissions for example. Likewise the motor 8 can drive the Jacquard apparatus 2 via an intermediate transmission. The motor 8 can act at various positions on the Jacquard apparatus 2, or also on the shaft 2*c*. Furthermore, the motor 3 can also be connected via clutches and transmissions to the shaft 1*a* of the weaving machine 1 so that the motor 3 is not directly connected to the main shaft of the weaving machine 1. The drive device 8** can be executed as a so-called servo amplifier comprising a rectifier, an intermediate d. c. circuit, a condenser, as well as an output stage for driving the motor. In addition the servo amplifier generally also has an angle of rotation sensor.

What is claimed is:

1. A Jacquard weaving machine comprising a weaving apparatus, a Jacquard apparatus connected to the weaving apparatus via a mechanical transmission device, a common motor for driving the weaving apparatus and the Jacquard apparatus, an additional drive device that acts at least on the Jacquard apparatus, and at least one torque sensor for the detection of a torque present between the weaving apparatus and the Jacquard apparatus at the mechanical transmission device, wherein the torque sensor is connected to a control device that controls the drive device in such a manner that fluctuations in the torque within the Jacquard weaving machine and/or fluctuations in the speed of rotation of the Jacquard weaving machine are reduced.

2. A Jacquard weaving machine in accordance with claim 1 wherein the torque sensor for the detection of the torque is provided at the mechanical transmission device.

3. A Jacquard weaving machine in accordance with claim 1 wherein an angle sensor is provided for the detection of the rotation angle of the Jacquard apparatus.

4. A Jacquard weaving machine in accordance with claim 1, wherein an angle sensor is provided for the detection of the angle of rotation of the weaving apparatus and a second angle sensor is provided for the detection of the angle of rotation of the Jacquard apparatus.

5. A Jacquard weaving machine in accordance with claim 1 wherein the mechanical transmission device comprises a shaft having transmissions.

6. A Jacquard weaving machine in accordance with claim 1, wherein an intermediate storage device is connected to the drive device in order to take up energy from the drive device and to give it back to the latter.

7. A method for the control of a Jacquard weaving machine comprising a weaving apparatus and a Jacquard apparatus that are connected to one another via a mechanical transmission device and are driven by a common motor, the method comprising:

detecting with a control device at least one of an angle of rotation and torque arising between the weaving apparatus and the Jacquard apparatus;

driving at least the Jacquard apparatus with a drive device; and controlling the drive device based at least in part upon values detected by the control device such that at least one of torque fluctuations, peak torque values and fluctuations in the speed of rotation are reduced.

8. A method in accordance with claim 7 further comprising:

measuring with the control device at least one of power consumption of the drive device and power consumption of the common motor; and controlling the drive device in such a manner that the total power consumption of the drive device and common motor are minimized.

9. A method in accordance with claim 7 further comprising operating the drive device to produce either a driving effect or a braking effect.

10. A method in accordance with claim 8 further comprising exchanging energy between the drive device and an intermediate storage device.

* * * * *